United States Patent [19]

Heckman, Jr.

[11] 4,051,447

[45] Sept. 27, 1977

[54] RADIO FREQUENCY COUPLER

[75] Inventor: LeRoy Francis Heckman, Jr., New Holland, Pa.

[73] Assignee: RCA Corporation, New York, N.Y.

[21] Appl. No.: 708,095

[22] Filed: July 23, 1976

[51] Int. Cl.[2] ..... H01P 5/04; H01P 5/08; H01P 1/16

[52] U.S. Cl. ..... 333/24 R; 333/27; 333/97 R

[58] Field of Search ..... 333/21 R, 27, 97 R, 333/33, 83 R, 98 R, 24 R, 26, 27; 330/56; 331/96, 99, 100, 101

[56] References Cited

U.S. PATENT DOCUMENTS

| | | | |
|---|---|---|---|
| 2,794,960 | 6/1957 | Ellis | 333/97 X |
| 3,166,723 | 1/1965 | Bock et al. | 333/98 X |
| 3,375,474 | 3/1968 | Thompson et al. | 333/97 X |
| 3,758,886 | 9/1973 | Landry et al. | 333/97 R |
| 3,972,013 | 7/1976 | Shapiro | 333/97 R |

*Primary Examiner*—Saxfield Chatmon, Jr.
*Assistant Examiner*—Marvin Nussbaum
*Attorney, Agent, or Firm*—H. Christoffersen; Samuel Cohen; William Squire

[57] ABSTRACT

An output coupler for a radio frequency oscillator includes a coaxial transmission line connector having a center conductor terminating in a coupling loop in the oscillator, the terminated end of the loop being secured to the cavity wall of the oscillator. Both the magnitude and depth of penetration of the loop are concurrently adjustable without altering the orientation of the loop by sliding the transmission line and center conductor with respect to the cavity wall. When optimum coupling is achieved, the transmission line connector is clamped in place.

11 Claims, 3 Drawing Figures

RADIO FREQUENCY COUPLER

BACKGROUND OF THE INVENTION

1. Field of the Invention

The present invention relates to radio frequency couplers.

2. Description of the Prior Art

Heretofore, couplers for radio frequency signals, in particular output couplers for radio frequency oscillators such as pencil tube oscillators and the like, include a coaxial transmission line terminating in an inductive loop disposed in the oscillator cavity. This structure takes several forms. In one form a coaxial connector has its center conductor extending beyond the center conductor into the cavity of the oscillator and terminating in the oscillator in an inductive loop. The connector, the loop and the cavity are disposed in fixed relationship to form a loop having a fixed orientation and a fixed inductive coupling magnitude.

A single orientation coupling loop structure having a single coupling magnitude is not completely satisfactory in a mass production and mass end use environment. Fixed loop coupling cannot be adjusted to compensate for variations in production variables such as exist in tubes, cavity dimensions, etc. In this situation those oscillators that do not meet minimum specification requirements are discarded, which can be costly. In the mass production end use environment, fixed coupling limits the range of loads to which the oscillator can be coupled.

To overcome these problems has been difficult. In one embodiment, the prior art includes a coupling device wherein the loop is completely secured to a rotatable coaxial connector which is then secured to the oscillator cavity wall. As the connector is rotated in and out of the cavity, the magnitude of the loop disposed within the cavity is altered. The magnitude of the loop is defined by the area circumscribed by the loop, the loop lying in and defining a plane. One difficulty with this technique is that the rotation of the loop causes misorientation of the loop with respect to other elements within the cavity. The loop could in fact be adjusted too close to a high voltage element within the cavity with the resulting voltage arc causing damage to the oscillator or other systems. While it is still possible to provide optimum coupling by this technique for some situations, it is well known that large misorientations of the plane of the coupling loop within the RF circuit will cause a wide variation of loading on that circuit. In this case, if care is not taken, the wide variation in loading could cause damage to the oscillator. However, other techniques may be devised so that orientation of the loop is known and controlled. One underlying factor is assumed for variable loop coupling; that is, the loop is large enough to couple desired RF power from an oscillator that is capable of delivering that power. Great difficulty occurs meeting all of the requirements of a loop with sufficient area to couple desired RF power; i.e., small enough to allow sufficient spacing for high voltage hold off; mechanically stable for temperaure, shock, and vibration requirements; and mechanically adjustable.

SUMMARY OF THE INVENTION

A radio frequency signal coupler includes a first radio freqency transmission means having a cavity enclosed by an outer conductor. Second radio frequency transmission means are provided including an inner conductor formed into an inductive coupling loop disposed in the cavity. The loop has a given orientation and a settable transverse area value anywhere in a first range and a depth of penetration value in the cavity anywhere in a second range. Means are provided for setting the loop area and depth of penetration values to provide a given inductive coupling value without altering the orientation of the loop.

DESCRIPTION OF A PREFERRED EMBODIMENT

Figure 1:
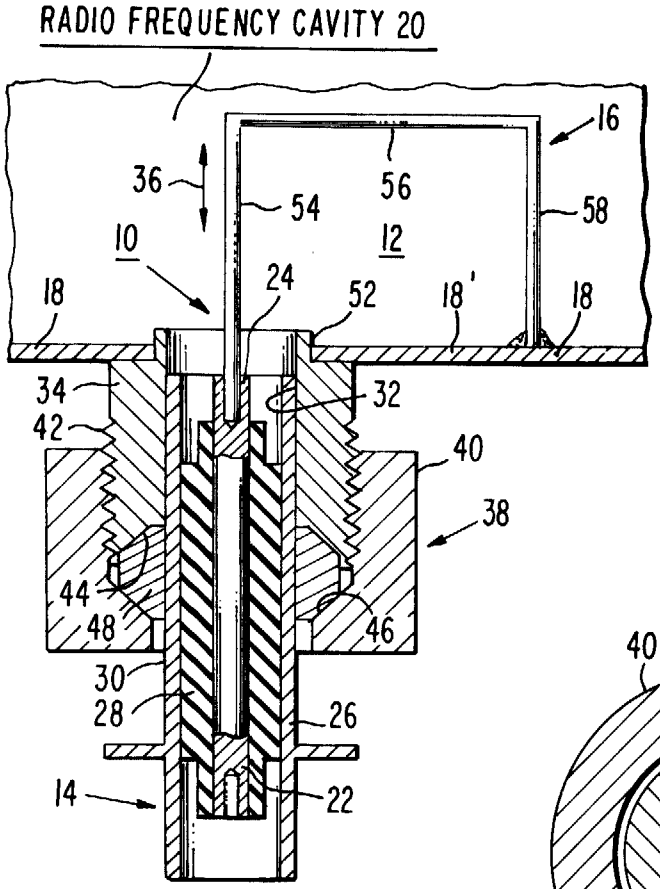

In FIG. 1, radio frequency output coupler 10 includes adjustable inductive loop 12. The adjustable part of loop 12 is formed by a conductive conductor 16, one end of which is electrically conductively connected to cavity wall 18 by soldering, welding or other suitable fastening arrangement. Conductor 16 is electrically conductively connected to the center conductor 22 of coaxial transmission connector 14. The conductor 16 is secured to center conductor 22 at 24 by inserting conductor 16 in a small hole in the end of conductor 22 and soldering or otherwise joining the two conductors together. The connector 14 comprises a cylindrical outer conductor 26. Disposed within conductor 26 is a suitable dielectric 28 within which is disposed conductor 22 in a conventional coaxial transmission configuration. The tubular outer surface 30 of conductor 26 is closely received within the cylindrical bore 32 of housing 34. Connector 14 is slideable in the axial direction 36 within bore 32 unless otherwise restrained.

Figure 2:
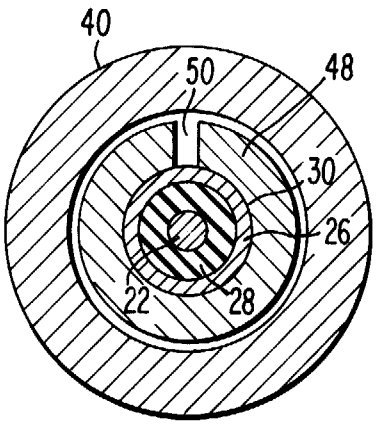
FIG. 2 is a transverse sectional view through the midsection of a device as illustrated in FIG. 1.

To lock the connector 14 in a given axial position with respect to housing 34 a suitable clamp 38 is provided. Clamp 38 includes an internally threaded ring 40 which is threaded onto an external thread 42 disposed about housing 34. Rotation of ring 40 on the thread 42 translates the ring 40 in the direction 36. Housing 34 has a conical concave end surface 44 and ring 40 has a conical concave surface 46 facing surface 44. Surfaces 44 and 46 form an adjustable tapered wedge cavity. Disposed about conductor 26 between surfaces 44 and 46 is split ring 48. Split ring 48 as best seen in FIG. 2 has an annular configuration with a small gap 50 forming a discontinuous ring. Ring 48 has two oppositely disposed conical convex surfaces mating with and contiguous with surfaces 44 an 46. Ring 48 is disposed about the outer surface 30 of conductor 26. The inner diameter of ring 48 is sized with respect to the outer diameter of conductor 26 such that compressing the ring 48 transversely in a manner to close the gap 50 of FIG. 2 tends to reduce the inner transverse diameter of the ring to a size smaller than the transverse diameter of conductor 26. By translating the ring 40 in the direction towards wall 18 the surfaces 44 and 46 compress the ring 48 in a wedge action therebetween, closing the inner transverse diameter of the ring 48 about conductor 26. The tightening action of ring 48 towards wall 18 securely clamps the conductor 26 of connector 14 to the ring 48 and thus to the housing 34, securely fastening the connector 14 to the wall 18.

Housing 34 includes a stepped shoulder 52 which is received within and secured to a suitable mating aperture in wall 18. The loop 12 inductively couples, in a well known manner, a radio frequency signal from a cavity 20 to a coaxial transmission line (not shown) via connector 14. Cavity 20 may be part of a radio frequency signal source such as the output circuit of a pencil tube oscillator output circuit structure in the vicinity where the coupling loop is disposed is in the form of a coaxial transmission line.

The conductor 16 of connector 14 is formed of a small gauge conductive wire of any suitable shape and is bent in a convenient manner to form the loop 12. As shown, the loop 12 comprises three flexible legs 54, 56 and 58, connected at right angles and one stiff leg 18' formed by wall 18. Electrically conductive leg 18' formed by wall 18 provides an electrical path from conductor 16 to electrically conductive conductor 26 of RF coaxial connector 14 by way of electrically conductive housing 34 and electrically conductive ring 48. This action permits the accurate matching of the radio frequency of cavity 20 to a load (not shown) connected to connector 14.

Figure 3:
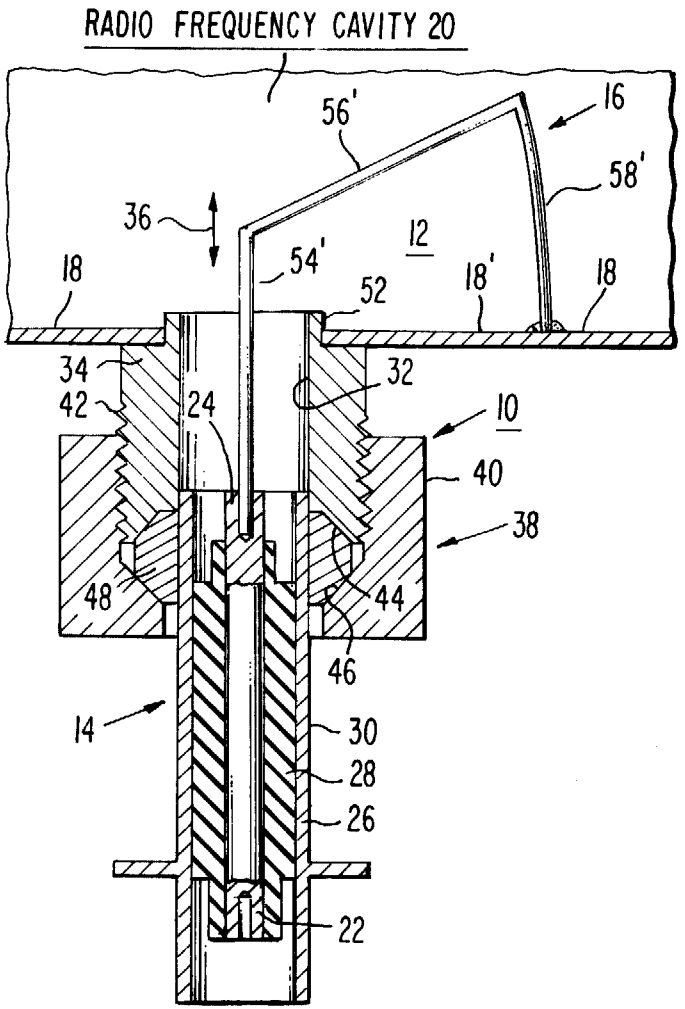
FIGS. 1 and 3 are side elevational sectional views of an embodiment of a device constructed and operated in accordance with the present invention.

To adjust the magnitude of the area defined by loop 12, connector 14 is translated in direction 36 either towards or away from the cavity wall 18. This action does not alter the orientation of the plane defined by loop 12. The axial movement of connector 14 permits accurate control of the transverse area of loop 12. This action provides an adjustment control of the inductive coupling between the cavity 20 and the loop 12. As seen in FIG. 3, the connector 14 has been displaced in the axial direction 36 away from cavity wall 18. It is seen that there has been distortion of the configuration of conductor 16 (legs 54', 56' and 58') and a reduction of the area of loop 12. The term distortion is defined in this instance to mean a change from a substantially rectangular configuration to a non-symmetrical configuration. Note that the relationship of the legs 54', 56' and 58' is distorted from the relationship of the legs 54, 56 and 58 of FIG. 1. The bendable, but relatively stiff conductor 16 forming loop 12 remains in any set position but is deformable as the connector 14 is translated. The plane defined by the legs 54', 56' and 58' is substantially in the same longitudinal orientation as the plane defined by the legs 54, 56 and 58 of FIG. 1. This is important since the reorientation of the plane of the loop will also affect the coupling characteristics of the loop. Since the orientation of the loop and the area defined by the loop both are parameters which independently affect the inductive coupling characteristics, the apparatus constructed and operated in accordance with the present invention alters only one of those two characteristics, i.e., the loop area. A third characteristic enters into the operation of the adjustable inductive coupling. The effective depth of penetration of the loop 12 within cavity 20 will vary as connector 14 is translated either towards or away from cavity wall 18. Most of the change in coupling occurs in the vicinity of legs 54 and 56 of conductor 16. Note that the depth of penetration of loop 12 in FIG. 3 has decreased over that shown in FIG. 1. Also note that most of the change has occurred in the vicinity of legs 54' and 56'. In the present invention the adjustable inductive coupling is comprised of reducing or enlarging the area of a loop and at the same time respectively decreasing or increasing the depth of penetration of the loop without affecting the orientation of the plane defined by the loop.

In the exemplary embodiment, which is constructed and operated in accordance with the present invention, the connector 14 includes a UG-914/U RF connector with about 0.75 inches of its 1.28 inch total length, conductor 26, machined smooth to an outer diameter of 0.381 inches. Conductor 26 and housing 34 have a clearance fit of several thousands of an inch. Ring 48 maximum outer diameter is 0.4 inches, is about 0.25 inches in length, and has bevelled surfaces 44 and 46 of about 20° each with respect to direction 36. Housing 34 has a length of 0.5 inches, an outer diameter of 0.5 inches, and a thread of 24 turns per inch with a ½ inch diameter. Ring 40 is 0.45 inches in length. The radio frequency output coupler 10 is disposed with the loop 12 in cavity 20. Cavity 20 is in the form of a coaxial circuit whose cavity wall 18 has an inner diameter of 0.835 inches and has a center conductor outer diameter of 0.31 inches. The plane of loop 12 is placed in an approximately parallel and intersecting orientation with respect to the longitudinal axis of the coaxial center conductor of cavity 20. Conductor 16 of loop 12 includes a conductor of 16 AWG copper wire. Leg 54 has a length 0.35 inches, leg 56 a length of 0.6 inches and leg 58 a length of 0.2 inches. The useful range of translation of the connector 14 in a direction 36 is 0.2 inches.

The dimensions of the loop 12 were chosen so that the coupling could be optimized for maximum RF power output within the range of translation of connector 14 while working into a 50 ohm termination. Care was taken that the loop would not be constructed too close to the cavity 20 center conductor because of the presence of high voltage in that conductor.

In the illustrative embodiment described above herein, the apparatus constructed and operated in accordance with the present invention was implemented in an environment using a pencil tube oscillator. It should be understood that the apparatus may be used in conjunction with any suitable radio frequency coaxial transmission means, that the example and dimensions given are merely for purposes of illustration and shall not be construed as limiting in any way.

What is claimed is:

1. In combination, first transmission means including a first conductor, second transmission means including a second conductor having an end extending therefrom, means for securing said extended end to said first conductor with said second conductor formed into an inductive coupling loop having an inductive coupling value defined by a settable transverse area value and a settable depth value for coupling a radio frequency signal between said first and second means, said loop having a given orientation with respect to said first means, and means for flexing said extended end to alter said loop coupling vaue while maintaining said given orientation to thereby provide optimum coupling between said first and second transmission means.

2. The combination of claim 1 wherein said means for flexing includes means secured to said first conductor for moveably securing said second transmission means thereto.

3. The combination of claim 2 wherein said means for flexing includes an annular clamping member, said second means including an outer annular member disposed within said clamping member, said annular clamping member frictionally clamping said outer member in a clamp position and slideably engaging said outer member in a loop altering position.

4. The combination of claim 3 wherein said second means includes a cylindrical outer member, a dielectric disposed within said cylindrical member, said second conductor being disposed within said dielectric and extending along the longitudinal axis of said cylindrical member, said means for flexing including a housing secured to said outer member, and means secured to said housing for securing said second means to said housing.

5. A radio frequency coupler device comprising:

coaxial transmission means including an outer conductor, a dielectric disposed within said outer conductor, and an inner conductor disposed within said dielectric, said inner conductor including a flexible end portion extending beyond said outer conductor and spaced therefrom housing means slideably engaged with said outer conductor wherein said transmission means can translate with respect to said housing means and flex said end portion when said end portion is secured in a relatively fixed position with respect to said housing means, and clamp means coupled to said transmission means for securing said transmission means in a given relative position between said transmission means and said housing means.

6. In combination:

a first radio frequency transmission means having a cavity enclosed by an outer conductor, second radio frequency transmission means including an extending flexible inner conductor formed into a flexible inductive coupling loop disposed in said cavity and connected to said outer conductor in said cavity, said loop having a given orientation and a settable transverse area and depth of penetration value in said cavity, said loop area having a value anywhere within a first given range, and a depth of penetration value anywhere within a second given range, and means for flexing said inner conductor to set said loop area and depth of penetration values to provide a given inductive coupling value without altering said orientation.

7. The combination of claim 6 wherein said loop area value is determined by the spaced relationship of said second means with respect to said first means, said means for flexing including means for slideably receiving said second means so that said second means can translate to a position spaced from said first means a distance having a value anywhere within a second given range, and means for securing said second means at said spaced position.

8. The combination of claim 7 wherein said receiving means includes a member having a cylindrical bore, said second means including a cylindrical outer member received in said bore for sliding along the longitudinal axis of said bore.

9. A radio frequency signal coupler comprising:

a housing having a cylindrical bore and an external thread concentric with said bore along the longitudinal axis of said bore, said housing having a first wedge surface, a coaxial transmission device including an inner conductor electrically conductively isolated from an outer cylindrical conductor, said inner conductor having an end extending beyond said outer conductor and formed into an open ended loop, said outer conductor being disposed in said bore for translation in a direction along said axis, an annular clamping member having an internal thread corresponding to and engaged with said housing thread, said clamping member having a second wedge surface facing said first surface, and a split clamping ring disposed between said first and second surfaces and contiguous with said outer cylindrical conductor, said ring having wedge surfaces corresponding to and facing said first and second surfaces and an inner transverse dimension determined by the spaced relationship of said first and second surfaces for securing said device to said housing.

10. In combination, first transmission means including a first conductor, second transmission means including a second conductor having an end extending therefrom, means for securing said extended end to said first conductor with said second conductor formed into an inductive coupling loop having an inductive coupling value defined by a settable transverse area value and a settable depth value for coupling a radio frequency signal between said first and second means, said loop having a given orientation with respect to said first means, and means including clamping means secured to said first conductor for slideable securing said second transmission means with respect to said first transmission means to alter said loop coupling value while maintaining said given orientation to thereby provide optimum coupling between said first and second transmission means, said clamping means including an annular clamping member, said second means including an outer cylindrical member disposed within said clamping member, a dielectric disposed within said cylindrical member, said second conductor being disposed within said dielectric and extending along the longitudinal axis of said cylindrical member, said clamping means further including a housing secured to said outer cylindrical member, and means secured to said housing for securing said second means to said housing, said annular clamping member frictionally clamping said outer member in a clamp position and slideably engaging said outer member in a loop altering position.

11. An arrangement for coupling a coaxial transmission line to a radio-frequency cavity, the outer conductor of the line being in electrical contact with a wall of the cavity at an opening in the wall through which a conductor can pass to the inner conductor of the line, comprising:

a flexible conductor which is electrically connected at one end to said wall of said cavity, inside of said cavity and which is electrically connected at its other end to the end portion of said inner conductor, said flexible conductor and a portion of said wall defining together the outline of a signal coupling area having a given orientation in said cavity; and means for changing both the penetration of said flexible conductor into said cavity and the size of said area without affecting the orientation of said area relative to said cavity comprising means for moving one end portion of said flexible conductor relative to said wall of said cavity while maintaining the other end portion of said flexible conductor in fixed position relative to said wall of said cavity.

* * * * *